United States Patent [19]

Rapp

[11] Patent Number: 4,832,423

[45] Date of Patent: May 23, 1989

[54] DOUBLE WALL DRAWER FRAME

[75] Inventor: Reinhold Rapp, Langenau, Fed. Rep. of Germany

[73] Assignee: Julius Blum Gesellschaft m.b.H., Höchst, Austria

[21] Appl. No.: 214,852

[22] Filed: Jul. 5, 1988

Related U.S. Application Data

[63] Continuation of Ser. No. 41,736, Apr. 21, 1987, abandoned.

[30] Foreign Application Priority Data

May 28, 1986 [AT] Austria ..... 1435/86

[51] Int. Cl.[4] ..... A47B 88/00

[52] U.S. Cl. ..... 312/341 NR; 312/330 R; 384/19; 384/20; 384/23

[58] Field of Search ..... 312/330, 338, 341 R, 312/341 NR; 384/19, 20, 23

[56] References Cited

U.S. PATENT DOCUMENTS

| | | | |
|---|---|---|---|
| 747,685 | 12/1903 | Coye | 312/330 R |
| 3,315,834 | 4/1967 | Nemlich | 312/330 R |
| 3,321,253 | 5/1967 | Everburg | 384/23 |
| 3,432,061 | 3/1969 | Anderson | 312/330 X |
| 4,172,625 | 10/1979 | Swain | 312/330 X |
| 4,392,696 | 7/1983 | Litchfield et al. | 312/330 R |

*Primary Examiner*—Joseph Falk

*Attorney, Agent, or Firm*—Wenderoth, Lind & Ponack

[57] ABSTRACT

A drawer has metal drawer frames or side walls and a front plate connected thereto by holding devices. At least one strip of plastics material or the like is fastened to the outer side of each of the drawer frames. The strips cover holes in the drawer frames, such holes providing access for a tool such as a screw driver to the front plate holding devices.

8 Claims, 1 Drawing Sheet

DOUBLE WALL DRAWER FRAME

This application is a continuation of now abandoned application Ser. No. 41,736, filed Apr. 21, 1987.

FIELD AND BACKGROUND OF THE INVENTION

The present invention relates to a drawer having metal drawer frames or side walls to which a front plate is fastened by front plate holding means, at least one strip of plastics material being fastened to the drawer frames and inserted into grooves in the drawer frames, and such grooves may have lateral undercuts.

Beside drawers each of which is made as an integral piece, in particular drawers of plastics material, drawers which are assembled of several parts are used. Such drawers are frequently provided with fittings which are part of the pull-out guide assembly and facilitate extraction and insertion of the drawer from and into the body of the piece of furniture.

Modern drawers of the afore-mentioned kind further have front plate holding means which allow adjustment of the position of the front plate after mounting thereof to correct the alignment of the drawer with respect to the joints and to the front plate of the piece of furniture, after the drawer has been inserted into the body of the piece of furniture.

Also metal drawer frames have frequently been in use. The runner roller of the pull-out guide device on the side of the drawer can be mounted at such metal drawer frames, and equally the pull-out flange of the pull-out guide assembly can be integrated with such drawer frame. In particular with drawers which are used in pieces of furniture for living rooms or kitchens, it is required to provide the metal drawer frames with coatings to enhance the overall appearance of the piece of furniture. A coating of plastics material generally is used, because metal is frequently considered as being "cold" in the living area.

It has been found that in the case of a deficient guiding of the drawer in the pull-out guide assembly the coating at the outer wall of the drawer often suffers considerable wear in the region which is closest to the furniture side wall. U.S. Pat. No. 3,315,834 discloses a drawer which has aluminum frames into which strips of plastics material are inserted.

SUMMARY OF THE INVENTION

It is the object of the invention to improve a drawer of the aforementioned kind in that the front plate holding means are completely covered, but nevertheless easily accessible.

According to the invention this is achieved in that the drawer frames are double-walled, and that the strips which are detachably fastened to the drawer frames cover holes in the drawer frames, such holes providing access for screw drivers or like tools to the front plate holding means.

The strips can, after the front plate has been precisely adjusted, be inserted into the drawer frames and then completely cover the front plate holding means. Thus, the esthetic appearance of the drawer is enhanced, and furthermore it is possible to prevent dust from entering into the parts of the front plate holding means.

It is advantageously provided that the strips extend over the length of the drawer frames.

To prevent effectively friction between regions of the drawer frames adjoining the strips and the furniture side walls, an embodiment of the invention provides that the strips laterally project from the drawer frames.

When the drawer according to the invention is being mounted into the body of the piece of furniture, the lateral distances between the drawer frames and the furniture side walls can be reduced to a minimum, even without the use of high-quality and hence expensive pull-out guide assemblies with special lateral guiding devices.

BRIEF DESCRIPTION OF THE DRAWINGS

In the following two embodiments of the invention will be described in more detail with reference to the accompanying drawings, in which.

DESCRIPTION OF THE PREFERRED EMBODIMENTS

Figure 1:
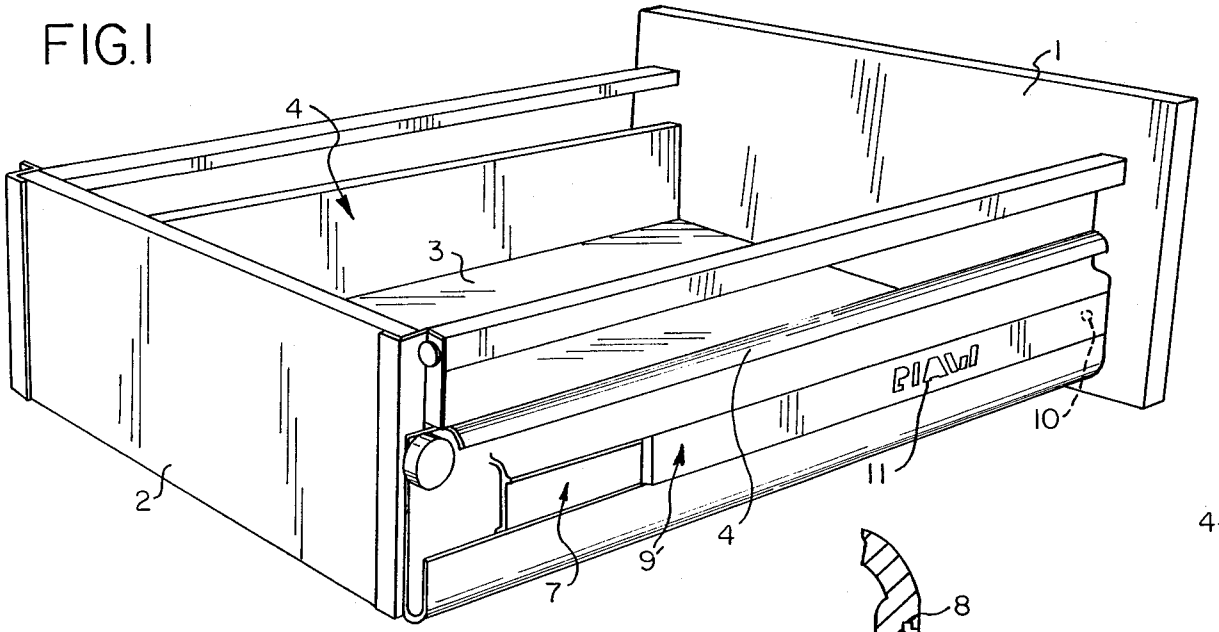
FIG. 1 is a perspective view of a drawer according to one embodiment of the invention.

The structural parts of a drawer are front plate 1, rear wall 2, bottom 3 and two drawer side walls or frames 4 according to the invention and which are of metal. As can be seen from the drawings, the metal drawer frames 4 are double-walled and comprise an inner wall 5 and an outer wall 6. Drawer frame 4 has a longitudinal roller guide channel 12.

Figure 3:
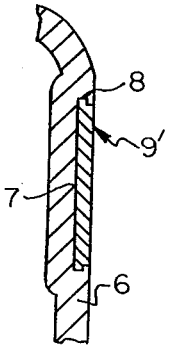
FIG. 3 is a sectional view through the outer wall of a drawer frame according to another embodiment of the invention.

The outer wall 6 is provided with a groove 7 that may have, according to the embodiment shown in FIG. 3, lateral undercuts 8.

A strip 9 of plastics material is inserted into each of the grooves 7 and extends in the illustrated embodiment over the full length of the drawer frame 4. In the embodiment of FIG. 3, strip 9 has lateral projections extending into undercuts 8.

Figure 2:
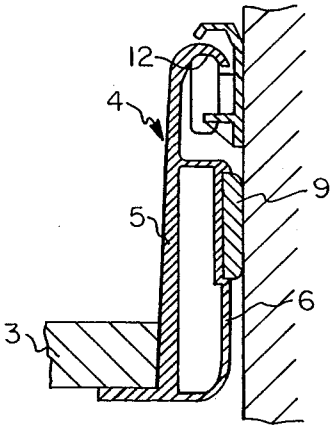
FIG. 2 is a sectional view through the drawer frame of such drawer.

As can be seen from FIG. 2, strip 9 laterally projects beyond the surface of the outer wall 6 of the drawer frame 4 and thus effectively prevents friction between the drawer frame 4 and an adjacent furniture side wall or a part of a pull-out guide assembly on the side of the body of the article of furniture. Each of the strips 9 cover, as shown in FIG. 1, a hole 10 which provides access for adjusting tools for adjusting means for mounting the front plate to the side wall or frame 4. Each strip 9 may be provided with an emblem 11, for example the furniture manufacturer's name.

Since the strips 9 can be inserted into the drawer frames 4, after the drawer has been asembled, the strips may be adapted to the color of the particular article of furniture or to the front plate 1. It is therefore possible to obtain to a certain extent conformity between the color and pattern of the front plate 1 and the drawer frames 4, even in cases when the drawer frames 4 are of metal whereas the front plate 1 may have different colors.

I claim:

1. In a drawer including opposite metal side drawer frames, and a front plate connected to front ends of said drawer frames, the improvement comprising:

each said drawer frame having a double wall construction including inner and outer walls, said inner wall defining a longitudinal roller guide channel, said outer wall having adjacent the front end thereof a hole providing access to holding means for connecting said front plate to said drawer frame and said outer wall having therein a longitudinal, inwardly directed groove extending parallel to said channel, said hole being located within said groove; and a longitudinal strip of plastic material removably mounted within said groove and covering said hole.

2. The improvement claimed in claim 1, wherein said strip projects outwardly beyond the outer surface of said outer wall.

3. The improvement claimed in claim 1, wherein said groove includes upper and lower undercut portions into which extend respective portions of said strip, thereby locking said strip laterally in said groove.

4. The improvement claimed in claim 1, wherein said strip extends over substantially the entire length of said groove.

5. A metal drawer frame for use on each of opposite sides of a drawer and having a front end to be connected to a drawer front panel, said drawer frame comprising:

inner and outer walls forming a double wall construction said inner wall defining, a longitudinal roller guide channel, said outer wall having adjacent the front end thereof a hole providing access to holding means for connecting said drawer frame to the drawer front panel, and said outer wall having therein a longitudinal, inwardly directed groove extending parallel to said channel, said hole being located within said groove; and a longitudinal strip of plastic material removably mounted within said groove and covering said hole.

6. A drawer frame as claimed in claim 5, wherein said strip projects outwardly beyond the outer surface of said outer wall.

7. A drawer frame as claimed in claim 5, wherein said groove includes upper and lower undercut portions into which extend respective portions of said strip, thereby locking said strip laterally in said groove.

8. A drawer frame as claimed in claim 5, wherein said strip extends over substantially the entire length of said groove.

* * * * *